United States Patent [19]

Clanton

[11] 4,307,549

[45] Dec. 29, 1981

[54] SKYLIGHT COVER

[75] Inventor: James A. Clanton, Wenonah, N.J.

[73] Assignee: RCA Corporation, New York, N.Y.

[21] Appl. No.: 94,753

[22] Filed: Nov. 15, 1979

[51] Int. Cl.[3] ..... E04B 7/18

[52] U.S. Cl. ..... 52/200; 52/1; 52/232; 52/309.4

[58] Field of Search ..... 52/1, 200, 232, 309.4; 428/910, 913

[56] References Cited

U.S. PATENT DOCUMENTS

| | | | |
|---|---|---|---|
| 2,957,483 | 10/1960 | Dunn | 52/309.4 |
| 3,619,344 | 11/1971 | Walinski | 428/910 |
| 3,620,898 | 11/1971 | Harris | 428/910 |
| 3,677,874 | 7/1972 | Sterrett | 52/309.4 |
| 3,731,442 | 5/1973 | Kiyoshi | 52/232 |
| 3,924,372 | 12/1975 | Anghinetti | 52/200 |
| 4,011,357 | 3/1977 | Haase | 428/910 |
| 4,106,399 | 8/1978 | Lawrence | 49/62 |
| 4,136,224 | 1/1979 | Minami | 428/910 |
| 4,190,987 | 3/1980 | Naldus | 52/1 |

FOREIGN PATENT DOCUMENTS

| | | | |
|---|---|---|---|
| 137130 | 8/1979 | Fed. Rep. of Germany | 52/1 |
| 1291385 | 3/1962 | France | 52/200 |
| 2355139 | 1/1978 | France | 52/1 |
| 1322703 | 7/1973 | United Kingdom | 52/200 |

*Primary Examiner*—Price C. Faw, Jr.
*Assistant Examiner*—Henry E. Raduazo
*Attorney, Agent, or Firm*—Samuel Cohen; William Squire

[57] ABSTRACT

A skylight cover which can be used as a heat and smoke vent for a roof of a building includes a cover which deforms and disengages from a curb structure on the roof, and is coated with a thermally insulating coating which thermally protects the cover from the cooling effects of ambient precipitation.

12 Claims, 6 Drawing Figures

SKYLIGHT COVER

Figure 1:
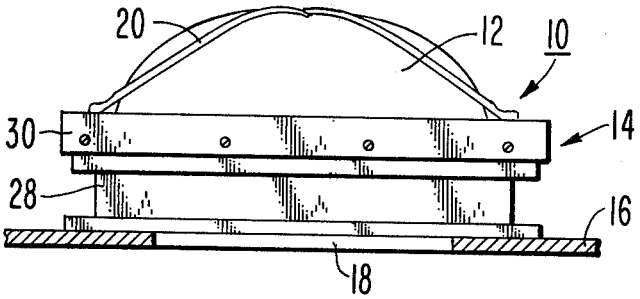

The present invention relates to skylight covers for openings in buildings or other structures.

Present thermoplastic sheet skylight covers comprise either single sheet members of thermoplastic material or what is known as "double dome" structures. The double dome structure comprises two spaced sheets of thermoplastic material which are sealed at their peripheral edges, with dead air space therebetween. The dead air space provides thermal insulation.

The single sheet thermoplastic skylight covers serve as heat and smoke vents which soften and fall through the openings over which they are mounted when heated to a given temperature. This allows heat and smoke to escape from the building during a fire. The problem with these single sheet members is that in the presence of precipitation, for example, when it rains, the rain cools the vent cover and this may prevent it from being heated sufficiently to soften, shrink and fall from its moorings.

One solution to the problem is to provide a shield member over a central portion of the single sheet skylight cover as discussed more fully in U.S. Pat. No. 3,731,442. The addition of a second thermoplastic sheet member to the structure, however, adds cost.

A skylight cover in accordance with the present invention comprises a sheet of light transmitting thermoplastic material and a coating of light transmitting and thermally insulating material on a surface of the sheet.

Figure 2:
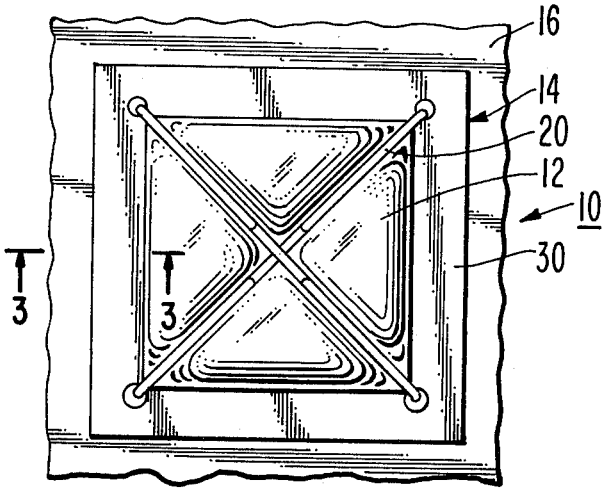
Figure 3:
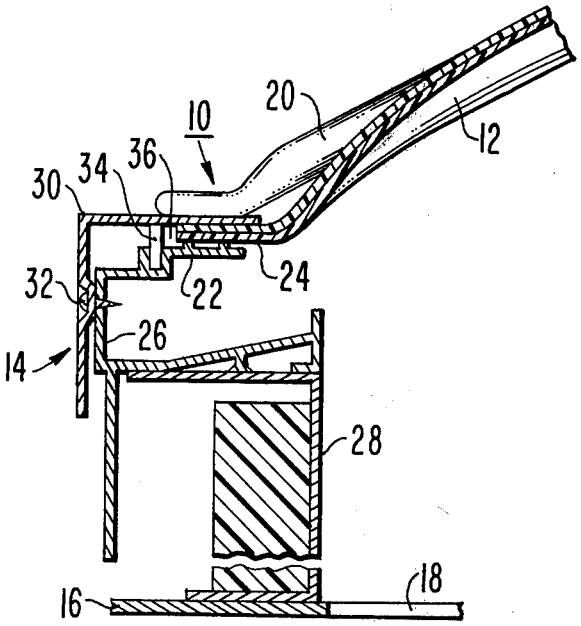
Figure 4:
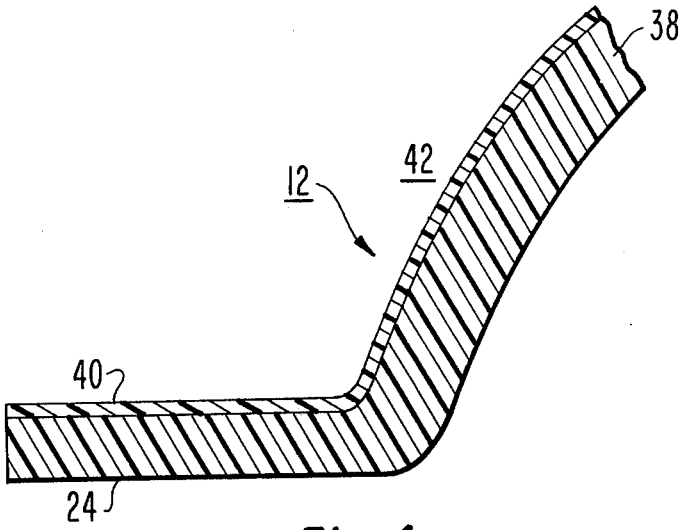
Figure 5:
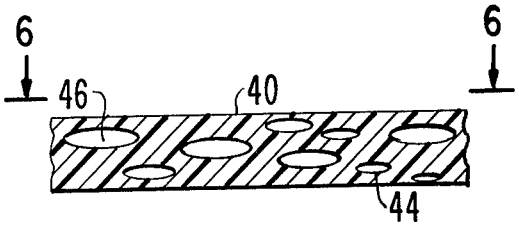
Figure 6:
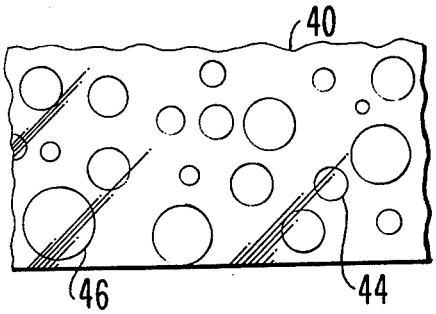

In the drawing:

FIG. 1 is a side elevation view of a skylight cover embodying the present invention, FIG. 2 is a plan view of the skylight cover of FIG. 1, FIG. 3 is a sectional view through the structure of FIG. 2 taken along lines 3—3, FIG. 4 is an enlarged sectional view of the skylight cover member similar to the view of FIG. 3, FIG. 5 is a still further enlarged sectional view of the coating on the skylight member of FIG. 4, and FIG. 6 is a plan view, this one in a plane parallel to the surface, of the coating of FIG. 5.

In FIG. 1 skylight construction 10 comprises a skylight member 12 mounted on a curb assembly 14 which is secured to a roof 16 on a building or other structure. A vent opening 18 is covered by the skylight construction 10. A framework 20 over a skylight member 12 and secured to the curb assembly 14 prevents personnel from accidentally falling through the skylight.

The curb assembly 14 preferably is constructed as shown in more detail in U.S. Pat. No. 4,080,763. Briefly, in FIG. 3, the curb assembly 14 includes a lip 22 on which is mounted flange 24 of the skylight member 12. Flange 24 and lip 22 extend around the periphery of the member 12. The lip 22 depends from upstanding sidewall 26 which is secured to a curb structure 28 mounted to the roof 16. An upper L-shaped apron 30 is secured to the lip 22 and wall 26 by means of an upstanding support 34 of a screw 32, respectively. The spacing 36 between lip 22 and the apron 30 is greater than the thickness of the member 12 so that the member 12 is loosely retained in the spacing 36. The frame structure 20 is welded or otherwise secured to the apron 30.

The member 12 is shown in more detail in FIG. 4 and comprises a sheet of thermoplastic heat softenable, heat shrinkable sheet material 38. Sheet material 38 may be polyvinylchloride and may be constructed as described in more detail in U.S. Pat. No. 3,918,226. Polyvinylchloride material is a fusible thermoplastic material that softens and distorts when subjected to high temperatures and does not support fire. This material has good weatherability characteristics, is translucent and serves advantageously as a building skylight as well as a building heat and smoke vent. Sheet material 38 may have a thickness of about 0.063 inches. The skylight of FIG. 1 and the sheet material 38 may have a number of different configurations as illustrated in FIGS. 7 and 8 of U.S. Pat. No. 3,918,226.

When used as a heat and smoke vent cover, sheet material 38 when raised to a given temperature, for example, above 430° F., softens and shrinks, with the center portion of the skylight member sagging, causing the flange 24 to disengage from the lip 22 sufficiently so that the skylight member 12 falls into the opening 18. This action opens the opening 18 to the ambient, permitting heat and smoke to escape.

In a skylight embodying the invention as shown in FIG. 4, sheet material 38 is coated with a coating 40. Coating 40 serves as a thermal insulator with respect to the sheet material 38. That is, the coating 40 insulates the sheet material 38 from the ambient air, designated 42. The coating 40 has a thermal insulation value greater than that of the material 38. If the coating 40 were of the same or a lower insulating value than the material 38, the effect produced by the coating could be accomplished merely by making the material 38 thicker. The purpose of the coating 40, however, is to avoid excessive increases in the thickness of the material 38 and at the same time to protect and insulate the material 38 from ambient precipitation such as falling rain. The coating 40 is significantly thinner than the thickness of material 38. Preferably, the coating 40 has a thickness in the range of 5–20 mils and preferably about 10 mils for a sheet material 38 having a thickness of 0.063 inches. Any suitable thermally insulating material which may be applied to the material 38 as a liquid and which subsequently cures into a weather-proof coating may be used.

For example, the coating 40 may be a layer of liquid vinyl sprayed over the entire exterior surface of the material 38 including its flange 24. The vinyl preferably is a clear coating when used for translucent skylights. The vinyl can be clear top coat vinyl VT-102E manufactured by the Bee Chemical Company of Lansing, IL. The coating of vinyl is applied directly as manufactured by the Bee Chemical Company. The coating may be sprayed with a spray gun such as a Binks model 18 or equivalent, employing a number 66 nozzle and a number 65 needle. The air pressure applied to the spray gun may have a range of 35–40 pounds per square inch (PSI). When spraying, the nozzle of the gun may be spaced from the surface of the material 28 about 5–7 inches. If the gun is placed closer, the liquid forms fewer air bubbles. The spacing also should be such that the vinyl does not solidify in the air prior to coating the material 28 and does not cause a condition known as "webbing". While spraying the gun should be in motion at all times to prevent the buildup of sprayed material, that is, to prevent unevenness in the sprayed layer thickness. Four passes of the gun over the surface, rotating the part 90° after each pass, provides one coat which has a thickness of about 2–2.5 mils dry film thickness. Each coating is allowed to dry 20 minutes in ambient air at room temperature to provide multiple coats. The coated parts are allowed to dry in air overnight or until all traces of solvent are evaporated.

A unit constructed as shown in FIG. 7 of U.S. Pat. No. 3,918,226 with a coating 40 9 mils thick over the entire surface of the sheet member 38 was subjected to the following test to check its performance. Water was sprayed over the surface at the rate of one half inch per hour. During such spray, a fire was placed centrally underneath the unit to create a temperature of approximately 430° F. for two minutes and then approximately 530° F. for the next three minutes. The fire was created by placing an alcohol gasoline mixture in a container under the unit and igniting the same. The unit softened and fell out of the curb assembly within a five minute time period.

Preferably, to increase its insulating characteristics, the coating 40 is provided with air bubbles 44, 46 as shown in FIGS. 5 and 6. The air bubbles are created by careful control of the spraying. The air bubbles increase the thermal insulation quality of the coating 40. The air bubbles 44 and 46 of FIG. 5 are trapped in the material as the vinyl is sprayed in each of the coatings. While it is not understood exactly what conditions will provide the maximum number of air bubbles, it is believed that one or more of the conditions described above (including spacing of the gun from surface being sprayed, movement of gun, multiple layers) are responsible for providing a satisfactory number of air bubbles. The air bubbles may measure anywhere from 1–20 mils in diameter in plan view as shown in FIG. 6. While the air bubbles produced in the coating enhance the thermal insulating qualities of the coating, the insulating value for the vinyl material itself forming the coating 40 is greater than that for the base material 38 forming the skylight member.

An additional factor involved when using the member 38 as a heat and smoke vent is that the coating 40 is sufficiently flexible such that it has a negligible effect on the shrinking and sagging of the sheet material 38 when exposed to heat. That is, the coating 40 adds negligible mechanical strength to the skylight member and offers relatively little resistance to the shrinking and sagging of the sheet material 38 when exposed to heat. As discussed above, a thickness of about 10 mils for the coating 40 accomplishes this result. While a coating with air bubbles is preferred in view of its greater insulating value, suitable performance also may be obtained with a solid coating of the same material, that is, one without air bubbles.

While the skylight cover shown herein preferably is used as a heat and smoke vent, it will occur to those of ordinary skill that such a skylight member can be used with a thicker coating 40 than as described for a heat and smoke vent and used in place of a double dome skylight as discussed in the introductory portion. Further, the insulating coating may be used on ordinary skylights to enhance their thermal insulating characteristics. In those instances where the thermal insulating characteristics of double dome skylight covers require a coating with a clear material, air bubbles are avoided. Of course, if air bubbles are placed in the coating then the air bubbles will diffract the light and make an otherwise clear material 38 translucent. By providing an insulating coating 40 having an increased insulating value over that of the material 38 and by eliminating the air bubbles 44 and 46, the coating may be made with a clear material and in that case will be transparent.

While the manner of applying the coating is preferably by spraying, the coating may also be applied by brushing, rolling or any other suitable technique. While vinyl material is shown in the present example, other liquids which provide insulating characteristics may be used instead.

What is claimed is:

1. A cover for a heat and smoke vent in a building roof comprising:

a vent adapted to be secured to the roof and forming a vent opening, a heat softenable and heat shrinkable sheet thermoplastic vent cover means capable of softening, shrinking, and sagging when heated to a given temperature, a thermally insulating coating in intimate contact with and bond to the outside surface of said sheet thermoplastic vent cover means capable of shrinking and sagging with said vent cover means, said coating insulating the cover means from the cooling effects of ambient precipitation, thereby permitting said cover to reach said given temperature when subjected to a given amount of heat from within said building, and thereby shrink and sag and disengage from the means set forth below for releaseably securing the vent, said coating being sufficiently thin to have negligible effect on the shrinking and sagging of said vent cover means and sufficiently thick to insulate said vent cover means from said cooling effects of ambient precipitation, and means for releaseable securing the vent cover means to the curb.

2. The cover of claim 1 wherein said coating is over the entire exterior surface of said cover means.

3. The cover of claim 1 wherein the coating is vinyl.

4. The cover of claim 1 wherein the coating contains air bubbles.

5. The cover of claim 1 wherein the coating has a thickness of at least 5 mils.

6. A thermoplastic skylight opening cover comprising:

a sheet of light transmitting thermoplastic material which is sufficiently rigid to maintain its shape when covering said opening, and a coating of light transmitting and thermally insulating material in intimate contact with and bond to the outside surface of said sheet, said coating being sufficiently thin to have negligible effect on the shrinking and sagging of said vent cover means and sufficiently thick to insulate said vent cover means from the cooling effects of ambient precipitation.

7. The cover of claim 6 wherein said coating is over an entire surface of said sheet.

8. The cover of claim 6 wherein the coating has an insulating value greater than said sheet.

9. The cover of claim 6 wherein the coating has a thickness sufficiently great to insulate said cover from the ambient and sufficiently thin to have negligible effect on the strength of said sheet.

10. The cover of claim 6 wherein the sheet shrinks, softens and sags when heated to a given temperature, said coating having negligible effect on the ability of said sheet to shrink, soften, and sag when heated to said temperature.

11. The cover of claim 6 wherein the coating is translucent.

12. The cover of claim 6 wherein the coating is vinyl.

* * * * *